US006745523B2

(12) United States Patent
Petta

(10) Patent No.: US 6,745,523 B2
(45) Date of Patent: Jun. 8, 2004

(54) FASTENING MEMBER FOR A WINDOW AND DOOR ASSEMBLY

(75) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 0 days.

(21) Appl. No.: 09/745,521

(22) Filed: Dec. 26, 2000

(65) Prior Publication Data

US 2002/0078640 A1 Jun. 27, 2002

(51) Int. Cl.[7] ..... E06B 1/04

(52) U.S. Cl. ..... 52/213; 52/312; 52/717.01; 52/745.15

(58) Field of Search ..... 52/204.5, 208, 52/204.53, 204.54, 204.62, 204.63, 204.69, 204.7, 204.72, 718.01, 718.04, 717.01, 745.15, 312, 716.8, 717.05, 717.06, 204.61, 211, 213

(56) References Cited

U.S. PATENT DOCUMENTS

| | | | | |
|---|---|---|---|---|
| 5,325,648 A | * | 7/1994 | Menard | 52/456 |
| 5,566,524 A | * | 10/1996 | Bettin | 52/717.01 |
| 6,148,584 A | * | 11/2000 | Wilson | 52/717.01 |
| 6,263,626 B1 | | 7/2001 | Gerhardt | 52/204.5 |

FOREIGN PATENT DOCUMENTS

| | | | | |
|---|---|---|---|---|
| DE | 3844195 A1 | * | 7/1990 | 52/213 |
| EP | 392342 A2 | * | 10/1990 | 52/213 |
| EP | 767727 B1 | * | 4/1997 | 52/213 |

OTHER PUBLICATIONS

English Language Translations of EP 0 392 342 A2 "Holz/Metall–Fenster".

* cited by examiner

*Primary Examiner*—Carl D. Friedman
*Assistant Examiner*—Naoko Stack
(74) *Attorney, Agent, or Firm*—Bereskin & Parr

(57) ABSTRACT

This invention relates to window and door assemblies, and particularly to a fastening member for fastening a first frame element of the assembly to a second frame element of the assembly. The fastening member can comprise a base, a first retaining member presented by the base to attach the fastening member to the first frame element, and a second retaining member presented by the base to attach the fastening member to the second frame element. Moreover, at least one of the first and second retaining members is adapted to attach the respective first and second frame element to the fastening member in sliding fit. Further, this invention discloses a method of attaching a first frame element of a window and door assembly to a second frame element of the assembly, particularly where the first frame element and the second frame element have differing rates of expansion and contraction along at least one given direction.

42 Claims, 14 Drawing Sheets

FASTENING MEMBER FOR A WINDOW AND DOOR ASSEMBLY

FIELD OF THE INVENTION

This invention relates to window and door assemblies, and particularly to a fastening member for fastening a first frame element of the assembly to a second frame element of the assembly. This invention also provides a method of fastening the first frame element of a window and door assembly to the second frame element of the assembly.

BACKGROUND OF THE INVENTION

Window and door assemblies for buildings are generally comprised of a number of frame elements. These frame elements are assembled to form the window and door assembly desired, for example, a casement window. Window and door assemblies are typically constructed from frame elements that are, for example, all wood, or constructed from frame elements that are, for example, all fabricated from an extrusion of resilient plastic material, such as, for example, polyvinyl chloride (PVC).

Window and door assemblies that utilize all wood frame elements have the attraction of presenting at least one wood face to an interior room of a building. The exterior surface can be provided with an extruded aluminum cladding or vinyl cladding to protect the exterior surface of the assembly from, for example, the sun's ultraviolet rays, and to provide an attractive finish to the assembly. Assemblies constructed from all wood frame elements can be expensive to manufacture and install, however.

Window and door assemblies that utilize frame elements that are all fabricated from an extrusion of resilient plastic material are generally cheaper to manufacture and install. For these assemblies the face that is presented to the interior room of a building can be laminated or capstocked to provide a desired finish, such as, for example, imitation wood finishes. However, the visual and tactile attraction of a laminated or capstocked surface on a plastic material is not generally desired by, for example, home purchasers.

It is therefore desirable to construct a window and door assembly using frame elements that are fabricated from a plastic material but using wood frame elements in the assembly construction wherever a wood finish is desired. For example, it would be desirable to use wood frame elements on a window assembly constructed primarily from plastic material frame elements on a facing of the assembly that is presented to an interior room of a building.

One problem with fastening wood frame elements to frame elements formed of a plastic material, however, is that the frame elements expand and contract at different rates when exposed to heat and cold. In particular, a plastic material generally expands and contracts when exposed to heat and cold in length, width, and thickness; wood generally expands and contracts in width and thickness, but not length. Accordingly, if wood frame elements are fastened to frame elements formed of a plastic material the frame elements can be subjected to stress along at least the longitudinal direction of the wood when the frame elements are exposed to heat and cold.

SUMMARY OF THE INVENTION

The present invention is directed to a fastening member for fastening a first frame element of a window and door assembly to a second frame element of the assembly. The fastening member can comprise a base, a first retaining member presented by the base to attach the fastening member to the first frame element, and a second retaining member presented by the base to attach the fastening member to the second frame element. Moreover, at least one of the first and second retaining members is adapted to attach the fastening member to its respective first and second frame element in sliding fit. In a preferred embodiment of the invention the first frame element and the second frame element have differing rates of expansion and contracting along at least one given direction, for example, where the first frame element is wood and the second frame element is formed from a plastic material such as polyvinyl chloride. The sliding fit is to be along at least such given direction.

In the preferred embodiment, the fastening member is attached to the first frame element in sliding fit. The first retaining member can comprise at least one extension member extending from the base and adapted to slidingly engage at least a portion of the first frame element. The extension member can comprise at least one substantially planar part adapted to fit in sliding arrangement within a corresponding groove presented by the first frame element.

Moreover, the base and the first retaining member of the fastening member can form a cavity that receives in sliding fit at least a portion of the first frame element. In the embodiment disclosed, the base and the extension can form the cavity, and in particular the base and the substantially planar part form the cavity.

The base can also comprise an engagement member to attach the fastening member to the second frame element. The engagement member can comprise at least one detent for engaging a corresponding abutment surface presented by the second frame element. In a preferred embodiment, the engagement member securely attaches the fastening member to the second frame element.

In the preferred embodiment of the invention the fastening member presents the first retaining member so that it attaches the first frame element in sliding fit on one side of the fastening member, and presents the second retaining member so that it attaches the second frame element on other side of the fastening member.

In the preferred embodiment of the invention the fastening member is comprised of a plastic material or of metal, but is not to be limited to these materials. Moreover, the first frame element can be wood, but could also be formed from a PVC foam, for example.

This invention also provides for a window and door assembly, comprising a first frame element, a second frame element, and a fastening member. The fastening member, as described above, can comprise a base, a first retaining member presented by the base to attach the fastening member to the first frame element, and a second retaining member presented by the base to attach the fastening member to the second frame element so that at least one of the first and second retaining members is adapted to attach the fastening member to its respective first and second frame element in sliding fit.

Further, this invention discloses a method of fastening a first frame element of a window and door assembly to a second frame element of the assembly, particularly where the first frame element and the second frame element have differing rates of expansion and contraction along at least one given direction. The method comprises attaching the first frame element to a fastening member, and attaching the fastening member to the second frame element. In particular, the fastening member is adapted to attach to at least one of the first and second frame elements in sliding fit, and the sliding fit is along the said given direction.

In the preferred embodiment of the method the fastening member is attached to the first frame element in sliding fit. Moreover, the fastening member attaches the first frame element in sliding fit to one side thereof, and attaches the second frame element to the other side thereof.

Other features and advantages of the present invention will become apparent from the following detailed description. It should be understood, however, that the detailed description and the specific examples while indicating preferred embodiments of the invention are given by way of illustration only, since various changes and modifications within the spirit and scope of the invention will become apparent to those skilled in the art from this detailed description.

BRIEF DESCRIPTION OF THE DRAWINGS

The invention will now be described in relation to the drawings in which.

DETAILED DESCRIPTION OF THE INVENTION

The present invention is directed to window and door assemblies. For purposes of illustrating the invention, however, the following detailed description describes a window assembly as one preferred example of the invention.

Figure 1:
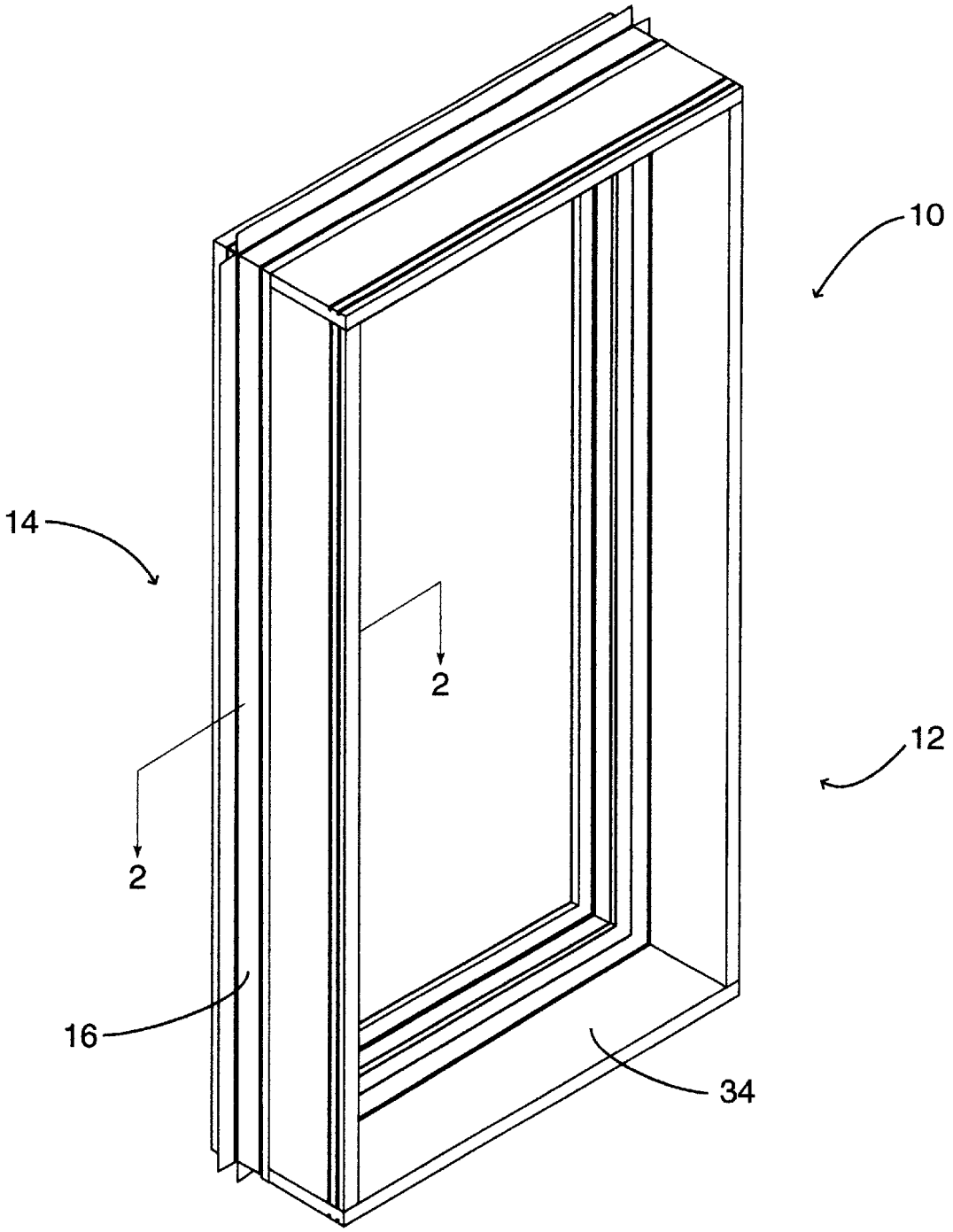
FIG. 1 is a perspective view of a window assembly comprised of frame elements which are all fabricated from an extrusion of resilient plastic material.
Figure 2:
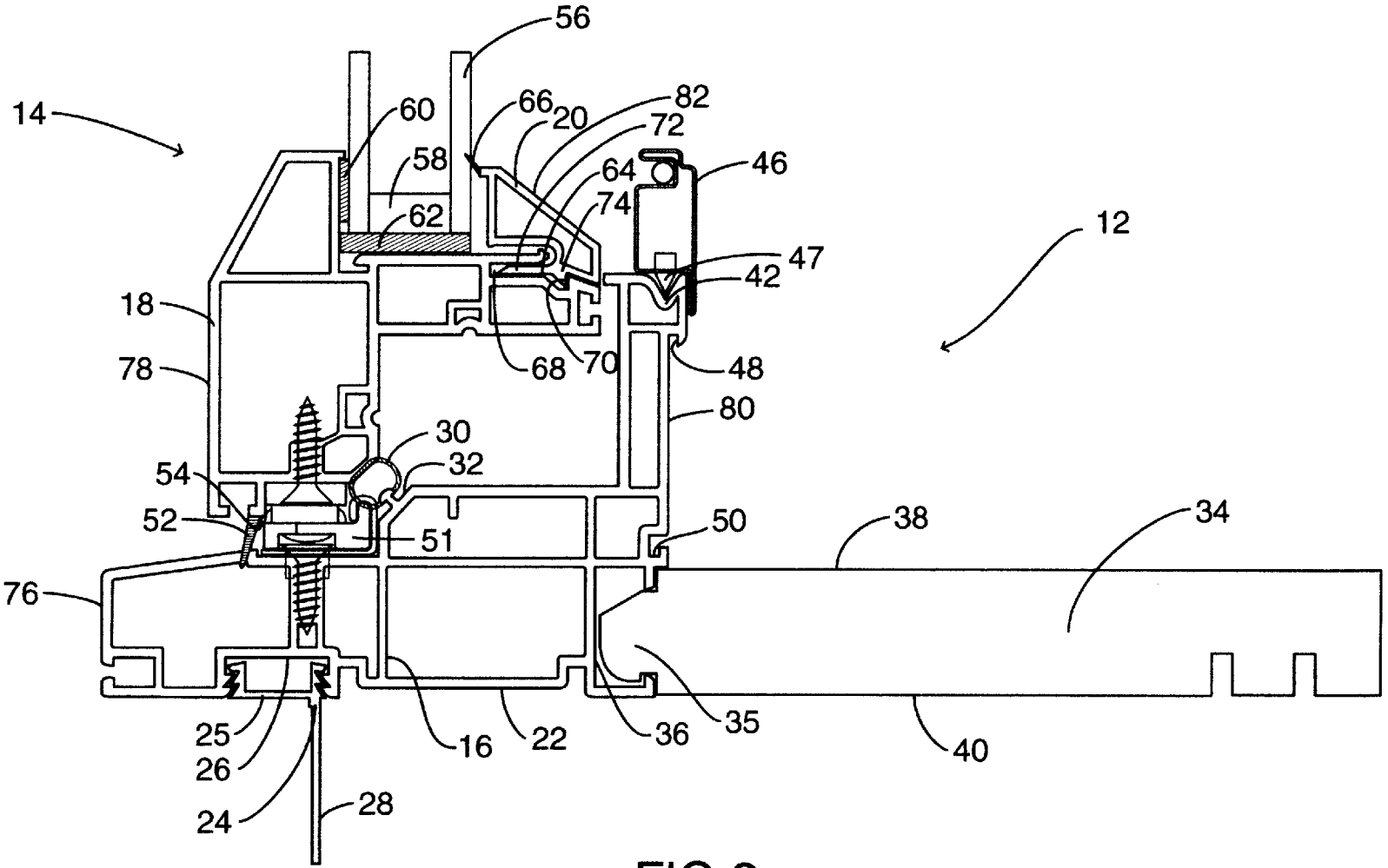
FIG. 2 is a cross-sectional view of the window assembly taken along the lines 2—2 of FIG. 1.
Figure 3:
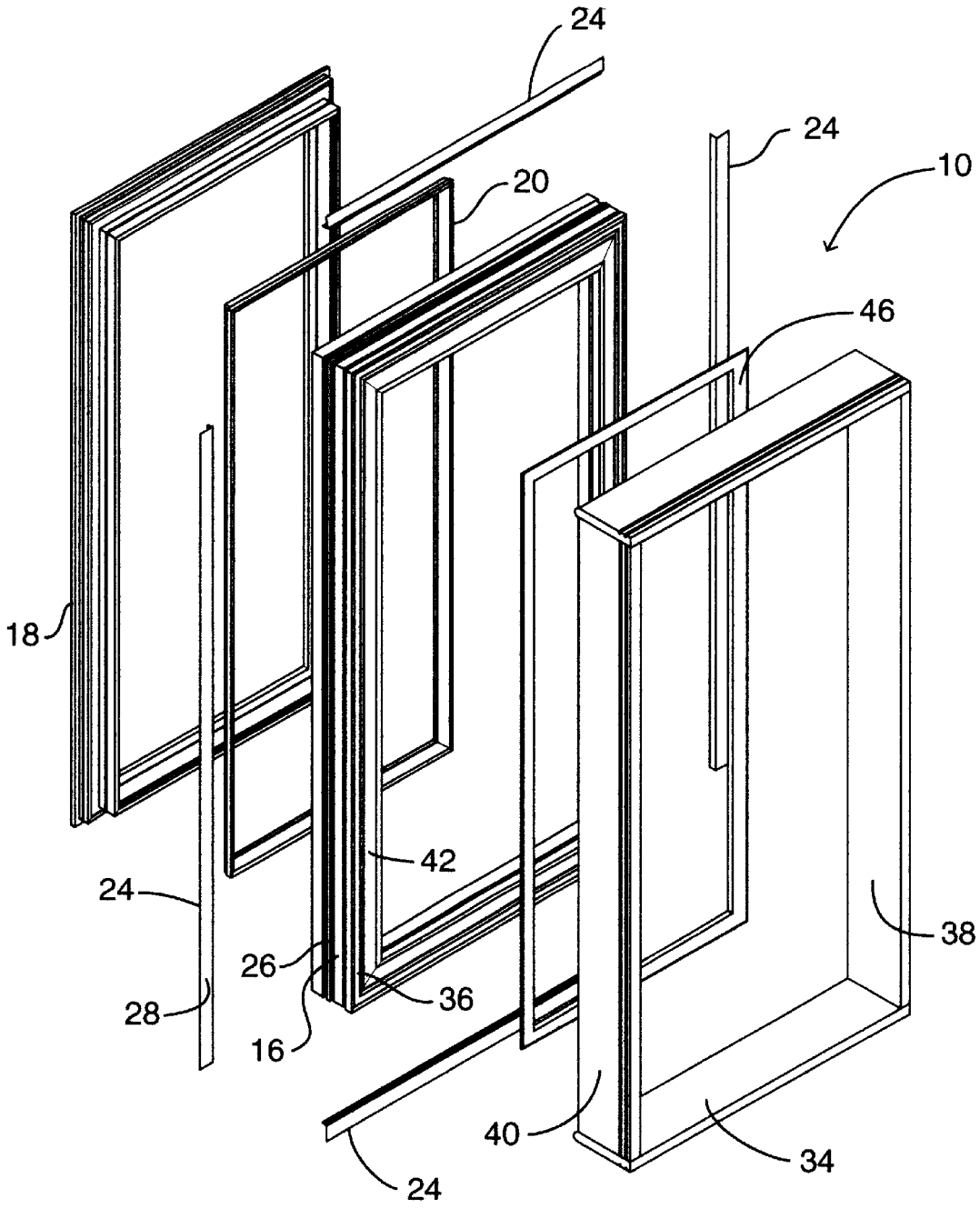
FIG. 3 is an exploded view of the window assembly of FIG. 1.

A window assembly 10 is illustrated in FIGS. 1–3, inclusive. Window assembly 10 is a casement window, but it can be appreciated that other types of window assemblies are intended to be covered by this invention. Window assembly 10 is constructed from individual frame elements all fabricated from an extrusion of resilient plastic material, such as, for example, polyvinyl chloride (PVC). It can be appreciated, however, that the individual frame elements can be constructed from other suitable materials, such as, for example, metal or aluminum. Window assembly 10 typically presents one side 12 to the interior of a building (not illustrated) and the other side 14 to the exterior of the building (not illustrated).

The individual frame elements used in constructing window assembly 10 typically comprise a main frame 16, a sash 18, and a glass stop 20. Main frame 16 has an outer surface 22 that can be presented to a frame of a building or to a further window assembly (not illustrated) to which window assembly 10 is secured. A nailing fin 24 is presented by main frame 16 to aid in securing window assembly 10 to the frame of the building. Nailing fin 24 is secured to main frame 16 by snapping the base 25 of the nailing fin in place as illustrated in FIG. 2 at 26. Nailing fin 24 provides a substantially planar surface 28 through which a suitable fastener (not illustrated), such as, for example, nails or screws, can be used to secure nailing fin 24 to the frame of the building.

Main frame 16 can also present weather stripping 30 from a surface 32 to form a seal between main frame 16 and sash 18. Further, a jamb extension 34 can be connected to main frame 16 by snapping the base 35 of the jamb extension in place as illustrated in FIG. 2 at 36. Jamb extension 34 presents one surface 38 to the interior of the building and a second surface 40 to the frame of the building to which window assembly 10 is secured. Main frame 16 can also present a portion 42 to which a screen 46 can be secured using, for example, spring pins 47.

Main frame 16 also provides abutment surfaces 48 and 50, the purpose of which will hereinafter be described in greater detail.

Sash 18 can be secured to main frame 16 by the use of, for example, hinges 51 suitably fastened to the sash and main frame by, for example, screws as illustrated in FIG. 2. Sash 18 presents a seal 52 from a surface 54 to form a further seal between sash 18 and main frame 16. Seal 52 can be formed from co-extruded rubber. Weather stripping 30 and seal 52 aid in preventing moisture, dust, wind, and other environmental hazards, from penetrating window assembly 10 to the interior of the building.

The illustrative example of window assembly 10, as shown in FIGS. 1–3, features double-sided thermal sealed glass 56 with the individual glass panes separated from one another by an aluminum or a rubber-based spacer bar 58. Glass 56 abuts against resilient surfaces 60 and 62 presented by sash 18, and is held in place by glass stop 20. Glass stop 20 is secured to sash 18 as at 64, and presents to glass 56 a flex strip 66 that firmly presses against glass 56 on the side opposite resilient surface 60. Flex strip 66 can be formed from a co-extruded rubber.

Glass stop 20 is secured to sash 18 as at 64 in the following manner. Sash 18 is provided with a slot 68 and an abutment surface 70. Glass stop 20 is provided with a substantially planar part 72 that fits within slot 68 provided by sash 18, and a corresponding detent in the form of a dovetail section 74, in the embodiment disclosed, to snap or clip into abutment surface 70 of sash 18. Snapping glass stop 20 in place on sash 18 presses flex strip 66 firmly against glass 56 thereby securing glass 56 in place between glass stop 20 and sash 18.

Surface 76 of main frame 16 and surface 78 of sash 18 are generally presented to the exterior of a building. These surfaces can be provided with a capstock (not illustrated) that can present a variety of finishes and colours for the exterior appearance of window assembly 10, as well as provide appropriate protection to window assembly 10 from, for example, the suns ultraviolet rays and other environmental hazards. Surface 80 of main frame 16 and surface 82 of glass stop 20 are generally presented to the interior of the building. These surfaces can be laminated or capstocked to provide a desired finish, such as, for example, to imitate a real wood finish.

Figure 4:
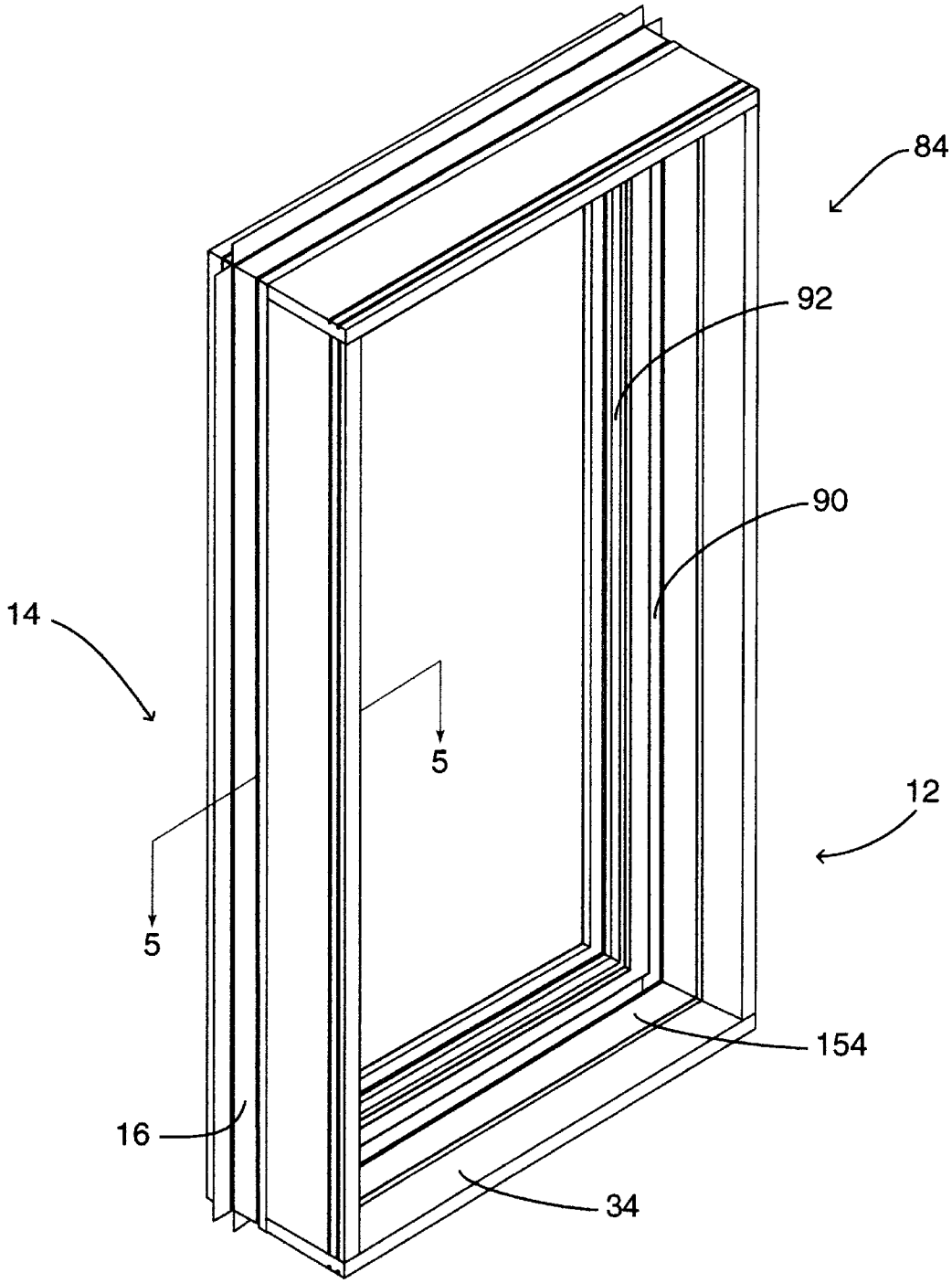
FIG. 4 is a perspective view of a window assembly comprised of frame elements fabricated from an extrusion of resilient plastic material and wood frame elements.
Figure 5:
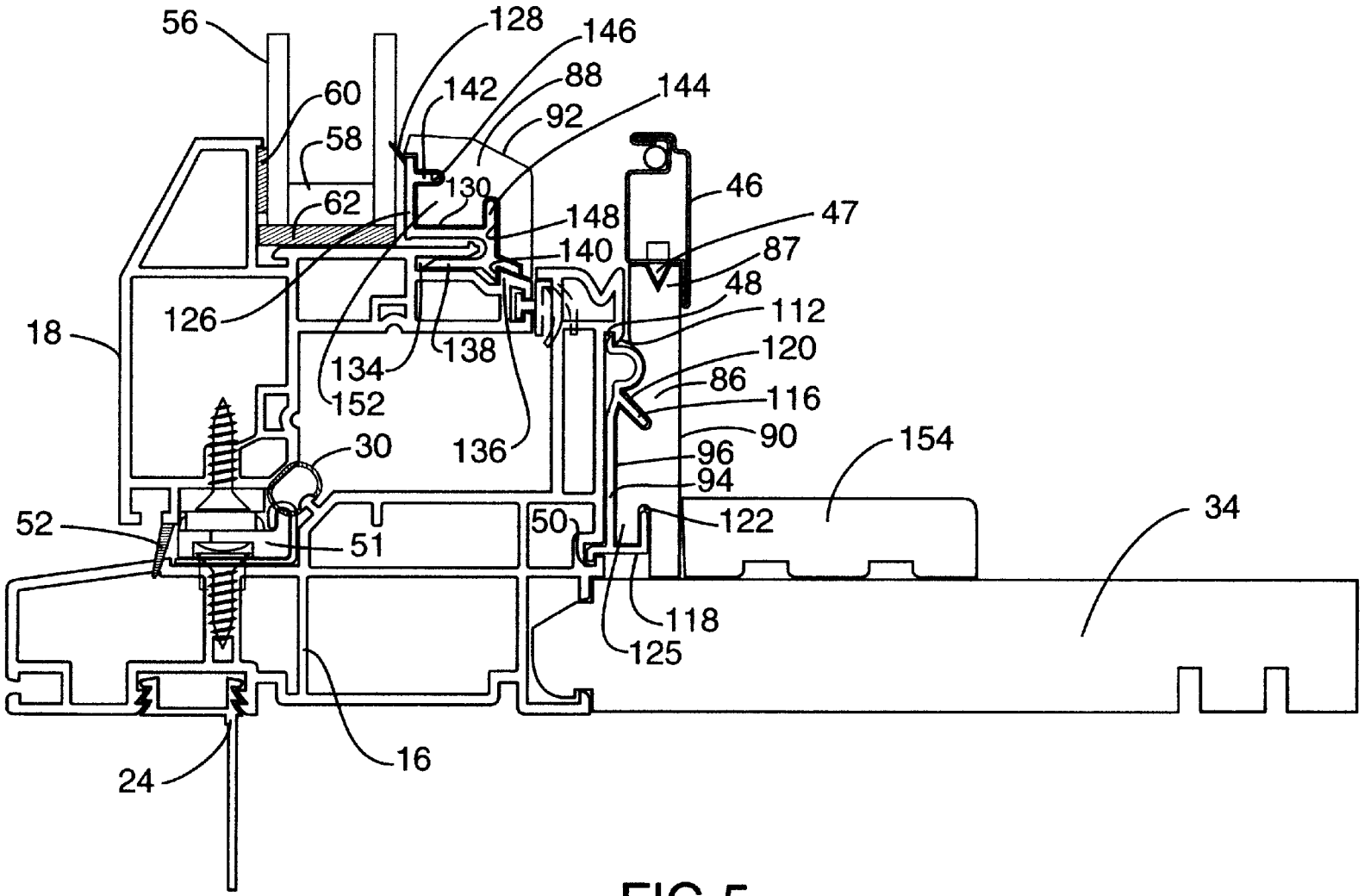
FIG. 5 is a cross-sectional view of the window assembly taking along the lines 5—5 in FIG. 4.
Figure 6:
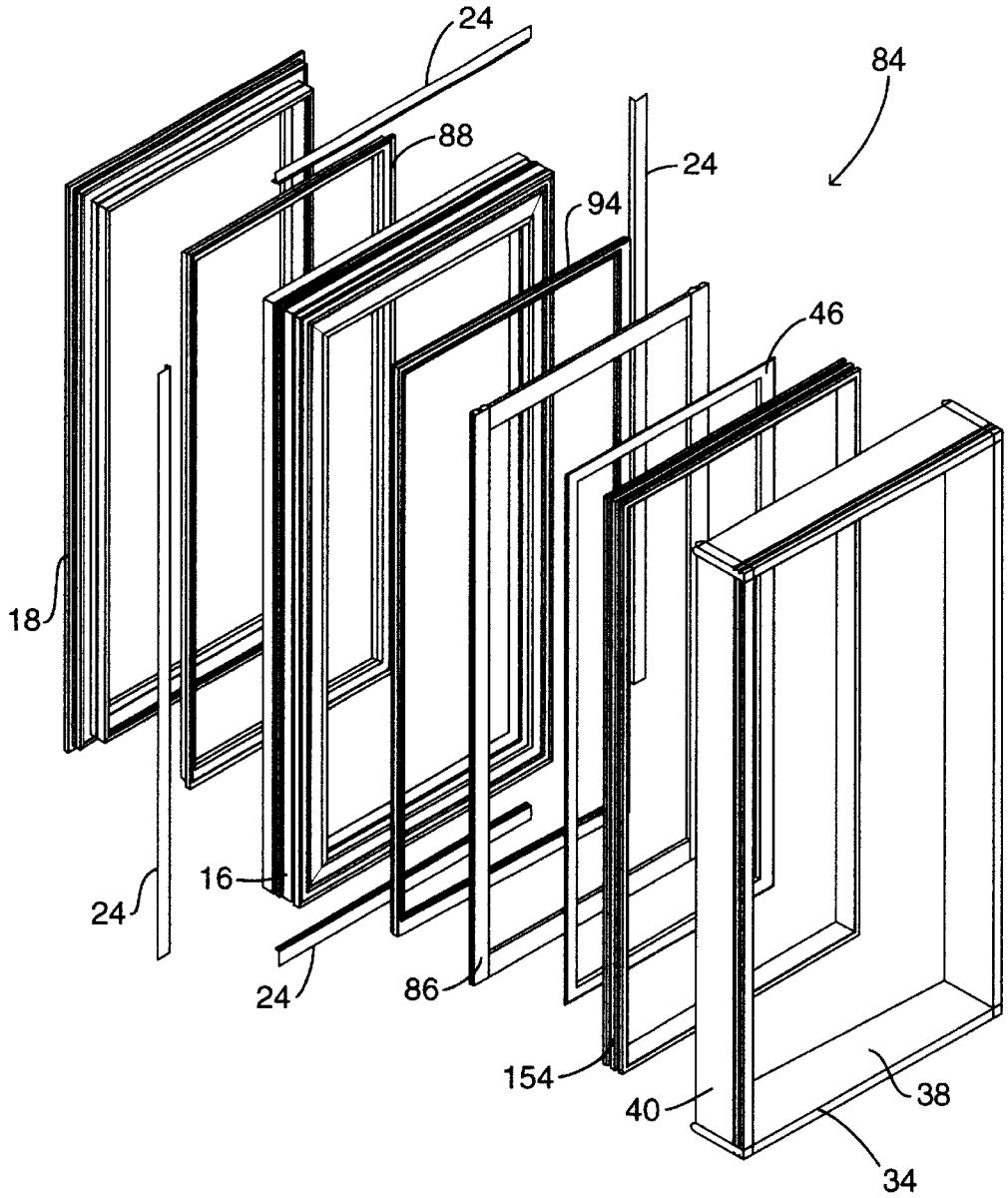
FIG. 6 is an exploded view of the window assembly of FIG. 4.
Figure 7:
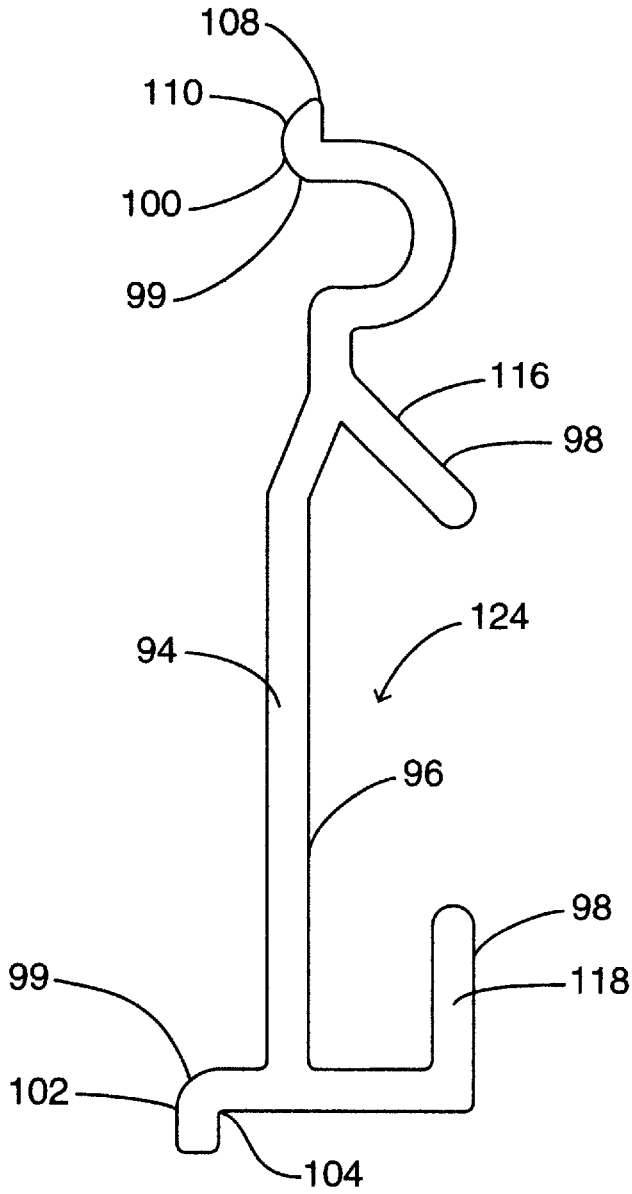
FIG. 7 is a side view of one embodiment of a fastening member of this invention.
Figure 8:
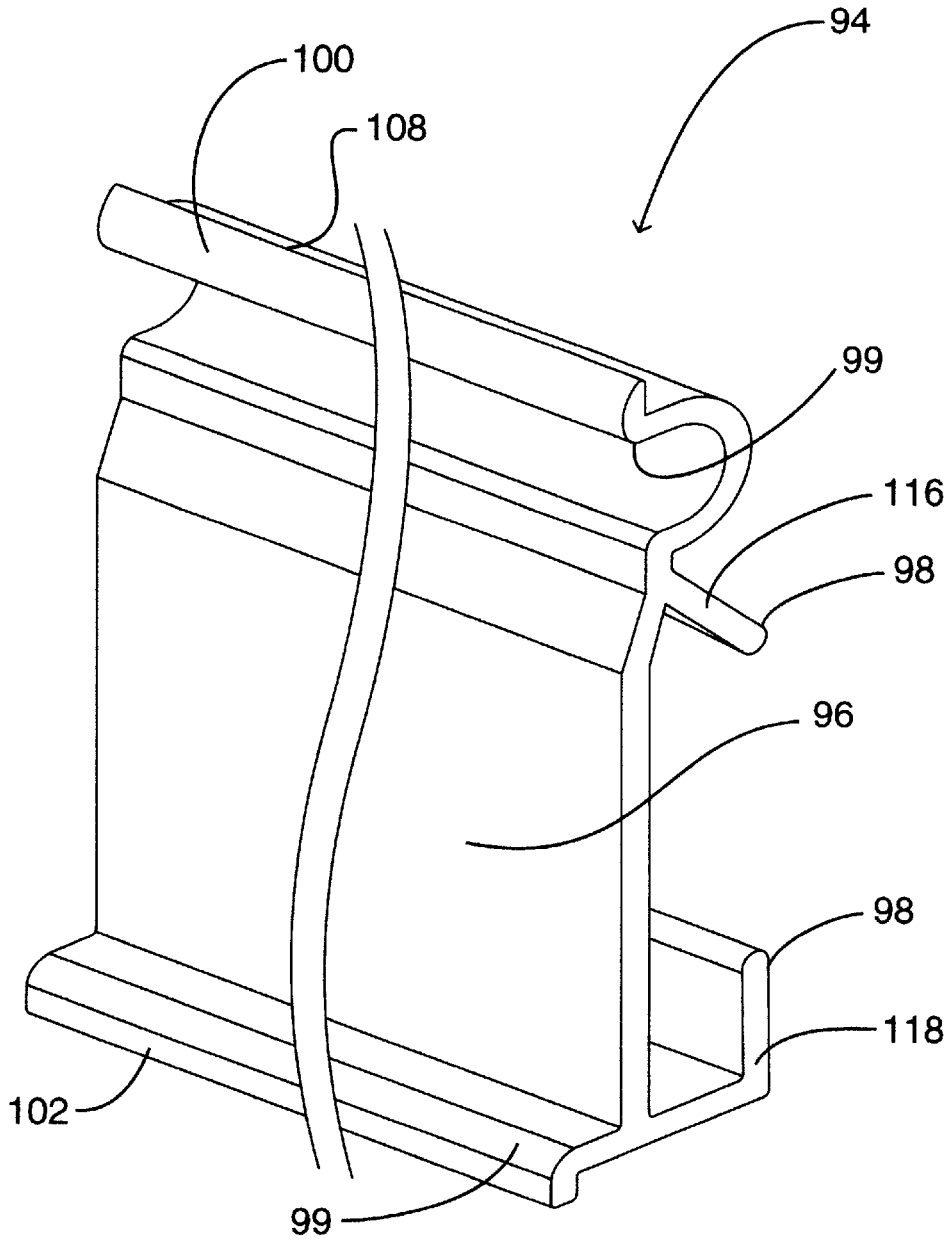
FIG. 8 is a perspective view of a portion of the fastening member illustrated in FIG. 7.
Figure 9:
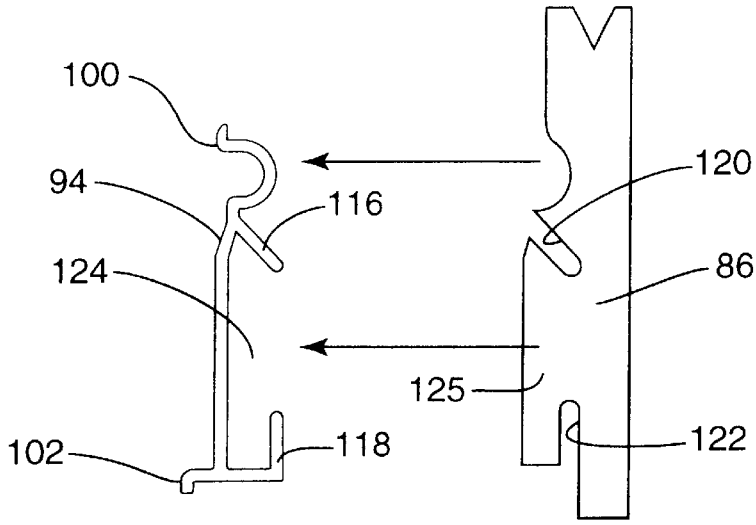
FIG. 9 is a side view showing the fastening member of FIG. 7 attaching to a frame element of the window assembly.

FIGS. 4–6, inclusive, disclose a window assembly 84 of the invention constructed from frame elements fabricated from a plastic material but using wood frame elements wherever a wood finish is desired, for example, on the facing of window assembly 84 that is presented to an interior room of a building. Window assembly 84 illustrated in FIGS. 4–6 is similar to window assembly 10 illustrated in FIGS. 1–3. Except where noted and described below the same reference characters will be used to identify the same parts in both sets of figures.

Window assembly 84 replaces the "plastic" surfaces 80 and 82 of main frame 16 and glass stop 20 by attaching all wood frame elements 86 and 88. Wood frame elements 86 and 88 present wood surfaces 90 and 92, respectively, to the interior of the building. It can be appreciated, however, that this invention is not limited to just wood frame elements. For example, frame elements 86 and 88 can be made from PVC foam or any other suitable material.

For the assembly illustrated in FIGS. 4–6, the wood frame element 86 is provided with the portion 87 to which a screen 46 can be secured using, for example, spring pins 47.

To fasten wood frame elements 86 and 88 to frame elements fabricated from a plastic material, such as, for example, main frame 16 and sash 18 for window assembly 84, a fastening member is provided. One example of a suitable fastening member for this invention is fastening member 94 as illustrated in FIGS. 7–10. Fastening member 94 fastens wood frame element 86 to main frame 16 for window assembly 84. Fastening member 94 comprises a base 96, a first retaining member 98, and a second retaining member 99. The first retaining member 98 attaches the wood frame element 86 to the fastening member 94, and the second retaining member 99 attaches the fastening member 94 to the main frame 16, as will hereinafter be described. The fastening members of this invention can be constructed from a plastic material, aluminum, nylon, fiberglass, spring metal, or any other material suitable for the purpose of the fastening members of this invention, as will hereinafter be described in greater detail.

To attach the wood frame element 86 to the fastening member 94 (see FIG. 9) the fastening member is slid over at least a portion of the frame element. In particular, the first retaining member 98 of fastening member 94 can be provided with an extension to slidingly engage at least a portion presented by the frame element 86. In the embodiment disclosed in FIG. 7, first retaining member 98 comprises two substantially planar parts 116 and 118 of a shape and configuration to fit in a sliding arrangement within corresponding grooves 120 and 122 presented by wood frame element 86. Moreover, as can be appreciated from FIG. 7, planar part 116 extends at an angle from base 96, while planar part 118 is generally an L-shaped extension. Together with base 96, planar parts 116 and 118 form a cavity 124 that receives in sliding fit portion 125 of wood frame element 86.

Figure 10:
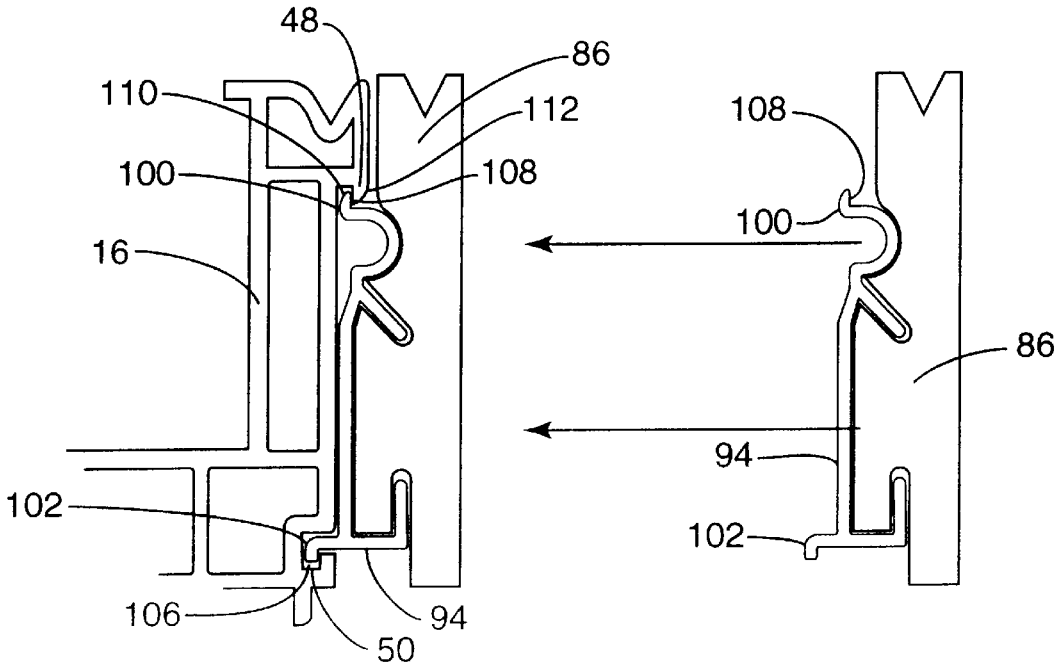
FIG. 10 is a side view showing the attaching of the fastening member with frame element of FIG. 8 to an additional frame element of the window assembly.
Figure 11:
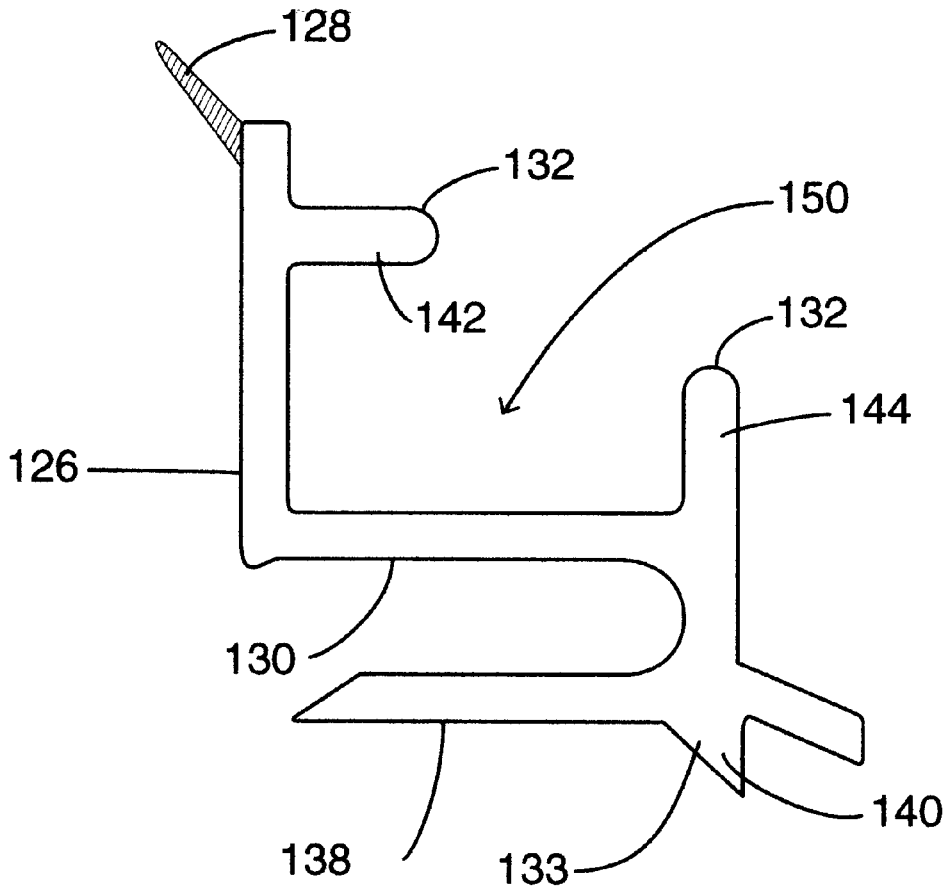
FIG. 11 is a side view of a second embodiment of the fastening member of this invention.
Figure 12:
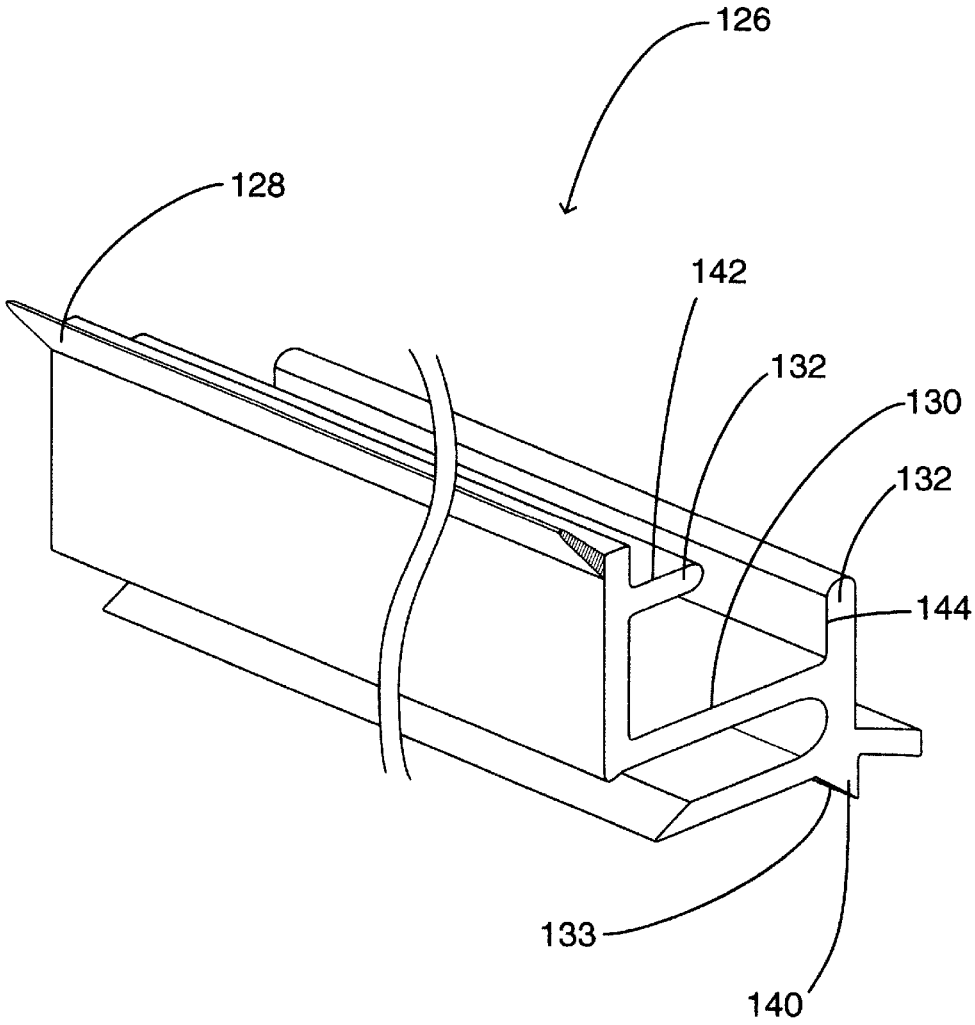
FIG. 12 is a perspective view of a portion of the fastening member illustrated in FIG. 11.
Figure 13:
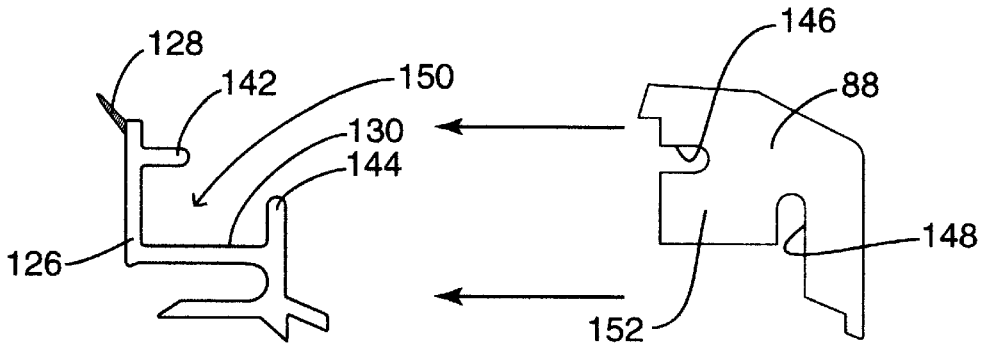
FIG. 13 is a side view showing the fastening member of FIG. 11 attaching to a frame element of the window assembly.

In the preferred embodiment, once frame element 86 is attached to fastening member 94, the fastening member with frame element 86 is then attached to main frame 16 (see FIG. 10). In the embodiment illustrated in FIG. 7 the second retaining member 99 is provided with an engagement member of a shape and configuration to engage abutment surfaces 48 and 50, respectively, of main frame 16. As illustrated in FIG. 5 and 10, the engagement member has a first part 100 of a shape and configuration to engage abutment surface 48, and a second part 102 of a shape and configuration to engage abutment surface 50. In particular, for the example of fastening member 94, the part 102 comprises a generally L-shaped extension 104 that can be inserted within a corresponding groove 106 provided by abutment surface 50 of main frame 16. Part 100 comprises a detent 108 to snap or clip into abutment surface 48. To aid detent 108 in snapping or clipping into abutment surface 48, detent 108 can be provided with a rounded surface, as at 110, that can ride over a rounded surface provided near abutment surface 48 by main frame 16, as at 112, when force is applied to fastening member 94.

First retaining member 98 is adapted to attach wood frame element 86 to fastening member 94 in a sliding fit. By attaching the wood frame element to the fastening member in sliding fit, and then the fastening member to a plastic frame element, such as main frame 16 (see FIGS. 9 and 10), the fastening member can accommodate differences in rates of expansion and contraction between the respective materials. For the particular example disclosed, the plastic material of main frame 16 generally expands and contracts when exposed to heat and cold in length, width, and thickness. Wood frame element 86 generally expands and contracts in width and thickness, but not length. As a consequence, when the main frame 16 and the wood frame element 86 are aligned with their respective lengths extending in a common direction, main frame 16 will expand and contract in relation to the wood frame element 86 along that direction. By using a fastening member of this invention a wood frame element can be fastened to a plastic frame element. Moreover, as seen from FIGS. 5 and 10 for the preferred embodiment disclosed, first retaining member 98 attaches frame element 86 in sliding fit on one side of the fastening member 94, and the second retaining member 99 attaches main frame 16 to the other side of the fastening member.

FIGS. 11–14 disclose an alternative fastening member 126 used, for the example of window assembly 84 as shown in FIGS. 4–6, to fasten wood frame element 88 to sash 18. As can be appreciated from FIG. 4, fastening member 126 also functions as the glass stop for window assembly 84 and features a flex strip 128 to firmly press against glass 56 on the side opposite resilient surface 60, when fastening member 126 is attached to sash 18. Flex strip 128 can be formed from a co-extruded rubber.

Fastening member 126 comprises a base 130, a first retaining member 132, and a second retaining member 133. The second retaining member 133 attaches fastening member 126 to sash 18, and the first retaining member 132 attaches wood frame element 88 to fastening member 126 in a sliding fit.

To attach wood frame element 88 to the fastening member 126 (see FIG. 13) the fastening member 126 is slid over at least a portion of the frame element. Again, the first retaining member 132 can be provided with an extension to slidingly engage at least a portion presented by the frame element 88. In the embodiment disclosed in FIG. 11, first retaining member 132 comprises two substantially planar parts 142 and 144 of a shape and configuration to fit in a sliding arrangement within corresponding grooves 146 and 148 presented by wood frame element 88. Moreover, as can be appreciated from FIG. 11, planar part 144 extends at a right angle from base 130, while planar part 142 is generally an L-shaped extension. Together with base 130 the substantially planar parts 142 and 144 form a cavity 150 that receives in sliding fit portion 152 of wood frame element 88.

Figure 14:
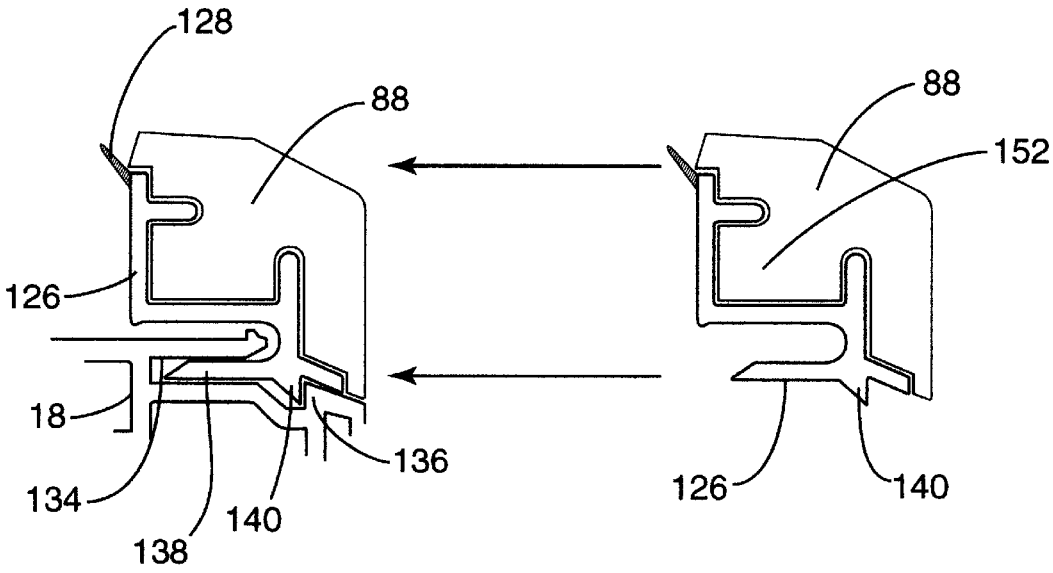
FIG. 14 is a side view showing the attaching of the fastening member with frame element of FIG. 13 to an additional frame element of the window assembly.

Again, once the frame element 88 is attached to fastening member 126, the fastening member with frame element 88 is then attached to sash 18 (see FIG. 14). For the example of fastening member 126 sash 18 is provided with a slot 134. Fastening member 126 has a substantially planar part 138 that fits within slot 134 provided by the sash. To securely attach the fastening member 126 to the sash 18, the second retaining member 133 of the fastening member is provided with an engagement member of a shape and configuration to an engage abutment surface 136 of sash 18. In the preferred embodiment, the engagement member for sash 18 is a detent in the form of a dovetail section 140 that snaps or clips into abutment surface 136 of sash 18. Again, as seen from FIGS. 5 and 14 for the preferred embodiment disclosed, first retaining member 132 attaches frame element 88 in sliding fit on one side of the fastening member 126, and the second retaining member 133 attaches sash 18 to the other side of the fastening member.

To complete the wood finish to the interior facing of window assembly 84 a wooden cove 154 can be secured to jamb extension 34 adjacent wood frame element 86 using, for example, finishing nails (not illustrated).

It can be appreciated that the fastening members of this invention can take on a variety of shapes and configurations. In all cases, however, the fastening members enable one frame element to be fastened to another frame element, particularly where the respective frame elements has differing rates of expansion and contraction along at least one given direction, for example, where one of the frame elements is formed from wood, while the other is formed of a plastic material.

Figure 15:
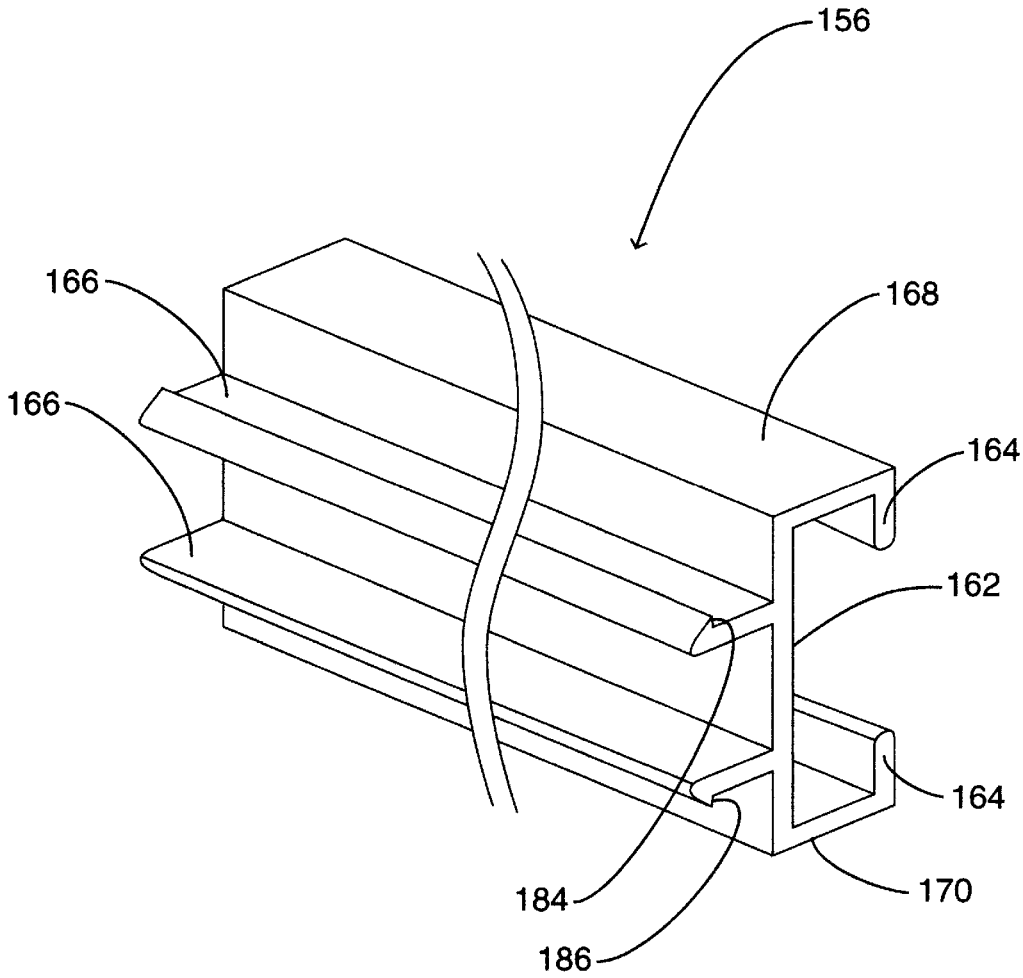
FIG. 15 is a perspective view of a portion of a third embodiment of the fastening member of this invention.
Figure 16:
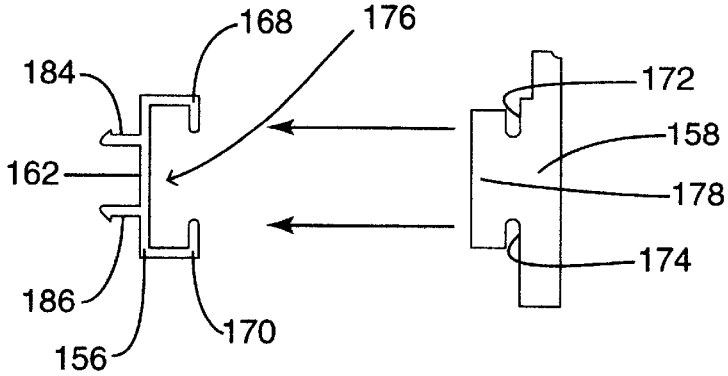
FIG. 16 is a side view showing the fastening member of FIG. 15 attaching to a frame element.
Figure 17:
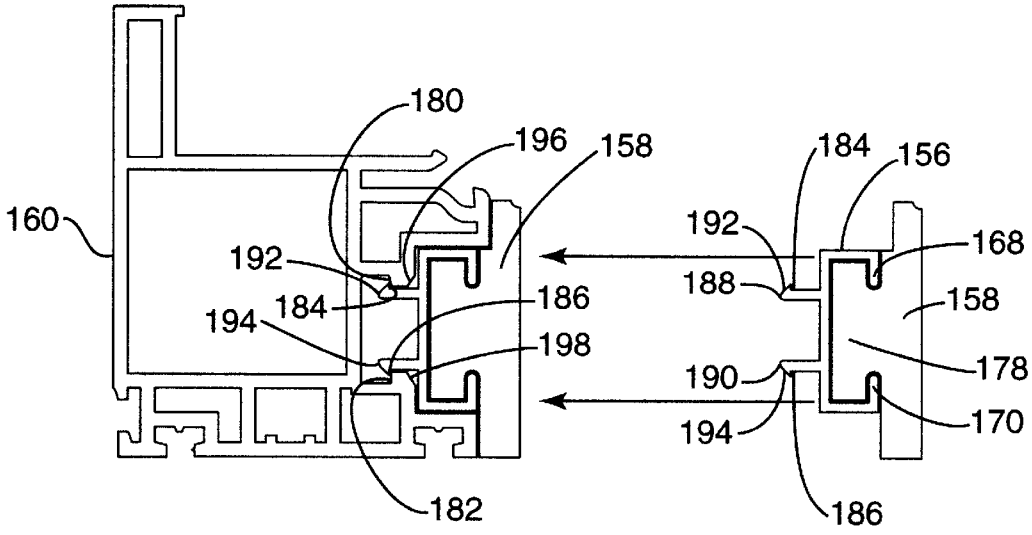
FIG. 17 is a side view showing the attaching of the fastening member with frame element of FIG. 16 to an additional frame.

For purposes of illustrating yet a further alternative embodiment of a fastening member, FIGS. 15–17 show a fastening member 156 suitable for use with, for example, a double hung frame or single hung sliders or patio doors. Fastening member 156 fastens a wood frame element 158 to a sash 160 of, for this example, a double hung frame. Fastening member 156 comprises a base 162, a first retaining member 164, and a second retaining member 166. The first retaining member 164 attaches the wood frame element 158 to the fastening member 156 and the second retaining member 166 attaches the fastening member 156 to the sash 160.

To attach the wood frame element 158 to the fastening member 156 (see FIG. 16) the fastening member is slid over at least a portion of the frame element. In particular, the first retaining member 164 of fastening member 156 can be provided with an extension to slidingly engage at least a portion presented by the frame element 158. In the embodiment disclosed in FIG. 15, first retaining member 164 comprises two substantially planar parts 168 and 170 of a shape and configuration to fit in a sliding arrangement within corresponding grooves 172 and 174 presented by wood frame element 158. Moreover, as can be appreciated from FIG. 15, both planar parts 168 and 170 are generally L-shaped extensions extending from base 162. Together with base 162, planar parts 168 and 170 form a cavity 176 that receives in sliding fit portion 178 of wood frame element 158.

In the preferred embodiment, once wood frame element 158 is attached to fastening member 156, the fastening member with frame element 158 is then attached to sash 160 (see FIG. 17). In the embodiment illustrated in FIG. 15 the second retaining member 166 is provided with an engagement member of a shape and configuration to engage abutment surfaces 180 and 182, respectively, provided by sash 160. As illustrated in FIG. 15, the engagement member has a first part 184 of a shape and configuration to engage abutment surface 180, and a second part 186 of a shape and configuration to engage abutment surface 182. In particular, for the example of fastening member 156, parts 184 and 186 comprise detents 188 and 190, respectively, to snap or clip into abutment surfaces 180 and 182, respectively. To aid detents 188 and 190 in snapping or clipping into abutment surfaces 180 and 182, detents 188 and 190 are provided with rounded surfaces, as at 192 and 194, respectively, adapted to ride over rounded surfaces, as at 196 and 198, respectively, provided near abutment surfaces 180 and 182, respectively, of main frame 16, when force is applied to fastening member 156.

Again, as seen from FIG. 17, first retaining member 164 attaches frame element 158 in sliding fit on one side of the fastening member 156, and the second retaining member 166 attaches sash 160 to the other side of the fastening member.

While the present invention has been described with reference to what are presently considered to be the preferred examples, it is to be understood that the invention is not limited to the disclosed examples. To the contrary, the invention is intended to cover various modifications and equivalent arrangements included within the spirit and scope of the appended claims.

I claim:

1. A fastening member to fasten a first frame element of a window and door assembly to a second frame element of the assembly, said fastening member comprising:

(a) a base;

(b) a first retaining member presented by the base and adapted to couple the fastening member to the first frame element; and (c) a second retaining member presented by the base and adapted to couple the fastening member to the second frame element, and wherein at least one of the first and second retaining members when coupled to the respective first and second frame elements is in sliding fit thereto.

2. The fastening member according to claim 1 wherein the first retaining member comprises at least one extension member extending from the base and adapted to slidingly engage at least a portion of the first frame element when the fastening member is coupled to the first frame element in sliding fit.

3. The fastening member according to claim 2 wherein the extension member comprises at least one substantially planar part adapted to fit in sliding arrangement within a corresponding groove presented by the first frame element.

4. The fastening member according to claim 3 wherein the base and the substantially planar part form a cavity that receives in sliding fit at least a portion of the first frame element when coupled to the fastening member.

5. The fastening member according to claim 2 wherein the base and the extension member form a cavity that receives in sliding fit at least a portion of the first frame element when coupled to the fastening member.

6. The fastening member according to claim 1 wherein the base and the first retaining member form a cavity that receives in sliding fit at least a portion of the first frame element when coupled to the fastening member.

7. The fastening member according to claim 1 wherein the second retaining member comprises an engagement member adapted to couple the fastening member to the second frame element when coupled to the fastening member.

8. The fastening member according to claim 7 wherein the engagement member comprises at least one detent that engages a corresponding abutment surface presented by the second frame element when coupled to the fastening member.

9. The fastening member according to claim 7 or 8, wherein the engagement member securely attaches the fastening member to the second frame element when coupled to the fastening member.

10. The fastening member according to claim 1 wherein the first retaining member attaches the first frame element in sliding fit on one side of the fastening member, and the second retaining member attaches the second frame element on the other side of the fastening member when coupled to the fastening member.

11. The fastening member according to claim 1 wherein the fastening member is comprised of a plastic material.

12. The fastening member according to claim 1 wherein the fastening member is comprised of metal.

13. A window and door assembly, comprising:

(d) a first frame element;

(e) a second frame element; and (f) a fastening member comprising a base, a first retaining member presented by the base and coupling the fastening member to the first frame element, and a second retaining member presented by the base and coupling the fastening member to the second frame element, and wherein at least one of the first and second retaining members when coupled to the respective first and second frame elements is in sliding fit thereto.

14. The assembly according to claim 13 wherein the first frame element and the second frame element have differing rates of expansion and contraction along at least one given direction, and the sliding fit is along said given direction.

15. The assembly according to claim 14 wherein the first retaining member of the fastening member comprises at least one extension member extending from the base and adapted to slidingly engage at least a portion of the first frame element so that the fastening member is coupled to the first frame element in sliding fit.

16. The assembly according to claim 15 wherein the extension member comprises at least one substantially planar part adapted to fit in sliding arrangement within a corresponding groove presented by the first frame element.

17. The assembly according to claim 16 wherein the base and the substantially planar part form a cavity to receive in sliding fit at least a portion of the first frame element.

18. The assembly according to claim 15 wherein the base and the extension member form a cavity to receive in sliding fit at least a portion of the first frame element.

19. The assembly according to claim 14 wherein the base and the first retaining member of the fastening member form a cavity to receive in sliding fit at least a portion of the first frame element.

20. The assembly according to claim 14 wherein the first retaining member of the fastening member couples the first frame element in sliding fit on one side of the fastening member, and the second retaining member couples the second frame element on the other side of the fastening member.

21. The assembly according to claim 14 wherein the first frame element is comprised of wood.

22. The assembly according to claim 14 wherein the first frame element is comprised of PVC foam.

23. The assembly according to claim 21 or 22 wherein the second frame element is comprised of a plastic material.

24. The assembly according to claim 23 wherein the fastening member is comprised of a plastic material.

25. The assembly according to claim 14 wherein the fastening member is comprised of a metal.

26. The assembly according to claim 13 wherein the second retaining member of the fastening member comprises an engagement member to couple the fastening member to the second frame element.

27. The assembly according to claim 26 wherein the engagement member comprises at least one detent for engaging a corresponding abutment surface presented by the second frame element.

28. The assembly according to claim 26 or 27 wherein the engagement member securely attaches the fastening member to the second frame element.

29. The assembly of claim 13 wherein the assembly comprises a glass pane, and at least one of the group consisting of the second frame element and the second frame element in combination with the fastening member securely holds the glass pane within the assembly.

30. The assembly of claim 29 wherein the first frame element is a wooden trim member for presenting a cosmetic wooden surface along an interior facing surface of the assembly.

31. The assembly of claim 13 wherein the first frame element and the fastening member are elongate and substantially equal in length.

32. The assembly of claim 31, wherein the sliding fit is in direction parallel to the length of the fastening member.

33. A method of attaching a first frame element of a window and door assembly to a second frame element of the assembly, the first frame element and the second frame element having differing rates of expansion and contraction along at least one given direction, the method comprising:

(a) attaching the first frame element to a fastening member; and (b) attaching the fastening member to the second frame element;

and wherein after steps (a) and (b), the fastening member is coupled to at least one of the first and second frame elements in sliding fit, and the sliding fit is along said given direction.

34. The method according to claim 33 wherein the fastening member is coupled to the first frame element in sliding fit.

35. The method according to claim 34 wherein the fastening member couples the first frame element in sliding fit on one side thereof, and couples the second frame element on the other thereof.

36. The method according to claim 34 wherein the first frame element is comprised of wood.

37. The method according to claim 34 wherein the first frame element is comprised of a PVC foam.

38. The method according to claim 36 or 37 wherein the second frame element is comprised of a plastic material.

39. The method according to claim 38 wherein the fastening member is comprised of a plastic material.

40. The method according to claim 39 wherein the fastening member is comprised of metal.

41. The method of claim 33 wherein the assembly comprises a glass pane, and wherein the fastening member is assembled to the second frame element by pressing the fastening member and second frame element together with an installation force directed generally perpendicular to the glass pane.

42. The method of claim 41 wherein step (a) is performed before step (b).

* * * * *